US007379871B2

(12) United States Patent
Shimakawa et al.

(10) Patent No.: US 7,379,871 B2
(45) Date of Patent: May 27, 2008

(54) SPEECH SYNTHESIZING APPARATUS, SPEECH SYNTHESIZING METHOD, AND RECORDING MEDIUM USING A PLURALITY OF SUBSTITUTE DICTIONARIES CORRESPONDING TO PRE-PROGRAMMED PERSONALITY INFORMATION

(75) Inventors: Masato Shimakawa, Kanagawa (JP); Nobuhide Yamazaki, Kanagawa (JP); Erika Kobayashi, Tokyo (JP); Makoto Akabane, Tokyo (JP); Kenichiro Kobayashi, Kanagawa (JP); Keiichi Yamada, Kanagawa (JP); Tomoaki Nitta, Tokyo (JP)

(73) Assignee: Sony Corporation, Tokyo (JP)

( * ) Notice: Subject to any disclaimer, the term of this patent is extended or adjusted under 35 U.S.C. 154(b) by 419 days.

(21) Appl. No.: 09/749,345

(22) Filed: Dec. 27, 2000

(65) Prior Publication Data

US 2001/0021907 A1 Sep. 13, 2001

(30) Foreign Application Priority Data

Dec. 28, 1999 (JP) ..... 11-373780

(51) Int. Cl.
*G10L 13/00* (2006.01)
*G10L 13/02* (2006.01)

(52) U.S. Cl. ..... 704/260; 704/10; 704/258; 704/272; 700/250

(58) Field of Classification Search ..... 704/260, 704/258, 270, 275, 207, 231, 219, 261, 268, 704/272, 10; 381/51; 395/267; 700/246, 700/250; 705/1

See application file for complete search history.

(56) References Cited

U.S. PATENT DOCUMENTS

| | | | | |
|---|---|---|---|---|
| 5,029,214 | A * | 7/1991 | Hollander | 704/258 |
| 5,559,927 | A | 9/1996 | Clynes | 395/267 |
| 5,615,301 | A * | 3/1997 | Rivers | 704/277 |
| 5,802,488 | A * | 9/1998 | Edatsune | 704/231 |
| 5,848,389 | A * | 12/1998 | Asano et al. | 704/239 |
| 5,860,064 | A | 1/1999 | Henton | 704/260 |
| 5,918,222 | A * | 6/1999 | Fukui et al. | 704/270 |

(Continued)

FOREIGN PATENT DOCUMENTS

| | | |
|---|---|---|
| EP | 0 730 261 | 9/1996 |

(Continued)

*Primary Examiner*—Patrick N. Edouard
*Assistant Examiner*—James S. Wozniak
(74) *Attorney, Agent, or Firm*—Frommer Lawrence & Haug LLP; William S. Frommer; Thomas F. Presson

(57) ABSTRACT

Various sensors detect conditions outside a robot and an operation applied to the robot, and output the results of detection to a robot-motion-system control section. The robot-motion-system control section determines a behavior state according to a behavior model. A robot-thinking-system control section determines an emotion state according to an emotion model. A speech-synthesizing-control-information selection section determines a field on a speech-synthesizing-control-information table according to the behavior state and the emotion state. A language processing section analyzes in grammar a text for speech synthesizing sent from the robot-thinking-system control section, converts a predetermined portion according to a speech-synthesizing control information, and outputs to a rule-based speech synthesizing section. The rule-based speech synthesizing section synthesizes a speech signal corresponding to the text for speech synthesizing.

13 Claims, 10 Drawing Sheets

U.S. PATENT DOCUMENTS 5,983,184 A * 11/1999 Noguchi ..... 704/270
6,072,478 A * 6/2000 Kurihara et al. ..... 715/500.1
6,088,673 A * 7/2000 Lee et al. ..... 704/260
6,112,181 A * 8/2000 Shear et al. ..... 705/1
6,144,938 A * 11/2000 Surace et al. ..... 704/257
6,160,986 A * 12/2000 Gabai et al. ..... 434/308
6,175,772 B1 * 1/2001 Kamiya et al. ..... 700/31
6,243,680 B1 * 6/2001 Gupta et al. ..... 704/260
6,260,016 B1 * 7/2001 Holm et al. ..... 704/260
6,290,566 B1 * 9/2001 Gabai et al. ..... 446/175
6,363,301 B1 * 3/2002 Tackett et al. ..... 700/246
6,446,056 B1 * 9/2002 Sadakuni ..... 706/14
6,598,020 B1 * 7/2003 Kleindienst et al. ..... 704/270
6,675,144 B1 * 1/2004 Tucker et al. ..... 704/264

FOREIGN PATENT DOCUMENTS

EP 1 107 227 6/2001
JP 08087289 A * 4/1996

* cited by examiner

SPEECH SYNTHESIZING APPARATUS, SPEECH SYNTHESIZING METHOD, AND RECORDING MEDIUM USING A PLURALITY OF SUBSTITUTE DICTIONARIES CORRESPONDING TO PRE-PROGRAMMED PERSONALITY INFORMATION

BACKGROUND OF THE INVENTION

1. Field of the Invention

The present invention relates to speech synthesizing apparatuses and methods, and recording media, and more particularly, to a speech synthesizing apparatus, a speech synthesizing method, and a recording medium which are mounted, for example, to a robot to change a speech signal to be synthesized according to the emotion and behavior of the robot.

2. Description of the Related Art

There have been robots which utter words. If such robots change their emotions and change the way of speaking according to the emotions, or if they change the way of speaking according to their personalities specified for them, such as types, genders, ages, places of birth, characters, and physical characteristics, they imitate living things more real.

The user will contact such robots with friendship and love as if they were pets. The problem is that such robots have not yet been implemented.

SUMMARY OF THE INVENTION

The present invention has been made in consideration of the above condition. It is an object of the present invention to provide a robot which changes the way of speaking according to the emotion and behavior to imitate living things more real.

The foregoing object is achieved in one aspect of the present invention through the provision of a speech synthesizing apparatus for synthesizing a speech signal corresponding to a text, including behavior-state changing means for changing a behavior state according to a behavior model; emotion-state changing means for changing an emotion state according to an emotion model; selecting means for selecting control information according to at least one of the behavior state and the emotion state; and synthesizing means for synthesizing a speech signal corresponding to the text according to speech synthesizing information included in the control information selected by the selecting means.

The speech synthesizing apparatus of the present invention may be configured such that it further includes detecting means for detecting an external condition and the selecting means selects the control information also according to the result of detection achieved by the detecting means.

The speech synthesizing apparatus of the present invention may be configured such that it further includes holding means for holding individual information and the selecting means selects the control information also according to the individual information held by the holding means.

The speech synthesizing apparatus of the present invention may be configured such that it further includes counting means for counting the elapsed time from activation and the selecting means selects the control information also according to the elapsed time counted by the counting means.

The speech synthesizing apparatus of the present invention may be configured such that it further includes accumulating means for accumulating at least one of the number of times the behavior-state changing means changes behavior states and the number of times the emotion-state changing means changes emotion states and the selecting means selects the control information also according to the number of times accumulated by the accumulating means.

The speech synthesizing apparatus of the present invention may further include substituting means for substituting for words included in the text by using a word substitute dictionary corresponding to selection information included in the control information selected by the selecting means.

The speech synthesizing apparatus of the present invention may further include converting means for converting the style of the text according to a style conversion rule corresponding to selection information included in the control information selected by the selecting means.

The foregoing object is achieved in another aspect of the present invention through the provision of a speech synthesizing method for a speech synthesizing apparatus for synthesizing a speech signal corresponding to a text, including a behavior-state changing step of changing a behavior state according to a behavior model; an emotion-state changing step of changing an emotion state according to an emotion model; a selecting step of selecting control information according to at least one of the behavior state and the emotion state; and a synthesizing step of synthesizing a speech signal corresponding to the text according to speech synthesizing information included in the control information selected by the process of the selecting step.

The foregoing object is achieved in still another aspect of the present invention through the provision of a recording medium storing a computer-readable speech-synthesizing program for synthesizing a speech signal corresponding to a text, the program including a behavior-state changing step of changing a behavior state according to a behavior model; an emotion-state changing step of changing an emotion state according to an emotion model; a selecting step of selecting control information according to at least one of the behavior state and the emotion state; and a synthesizing step of synthesizing a speech signal corresponding to the text according to speech synthesizing information included in the control information selected by the process of the selecting step.

In a speech synthesizing apparatus, a speech synthesizing method, and a program stored in a recording medium according to the present invention, a behavior state is changed according to a behavior model and an emotion state is changed according to an emotion model. Control information is selected according to at least one of the behavior state and the emotion state. A speech signal is synthesized corresponding to a text according to speech synthesizing information included in the selected control information.

DESCRIPTION OF THE PREFERRED EMBODIMENTS

Figure 1:
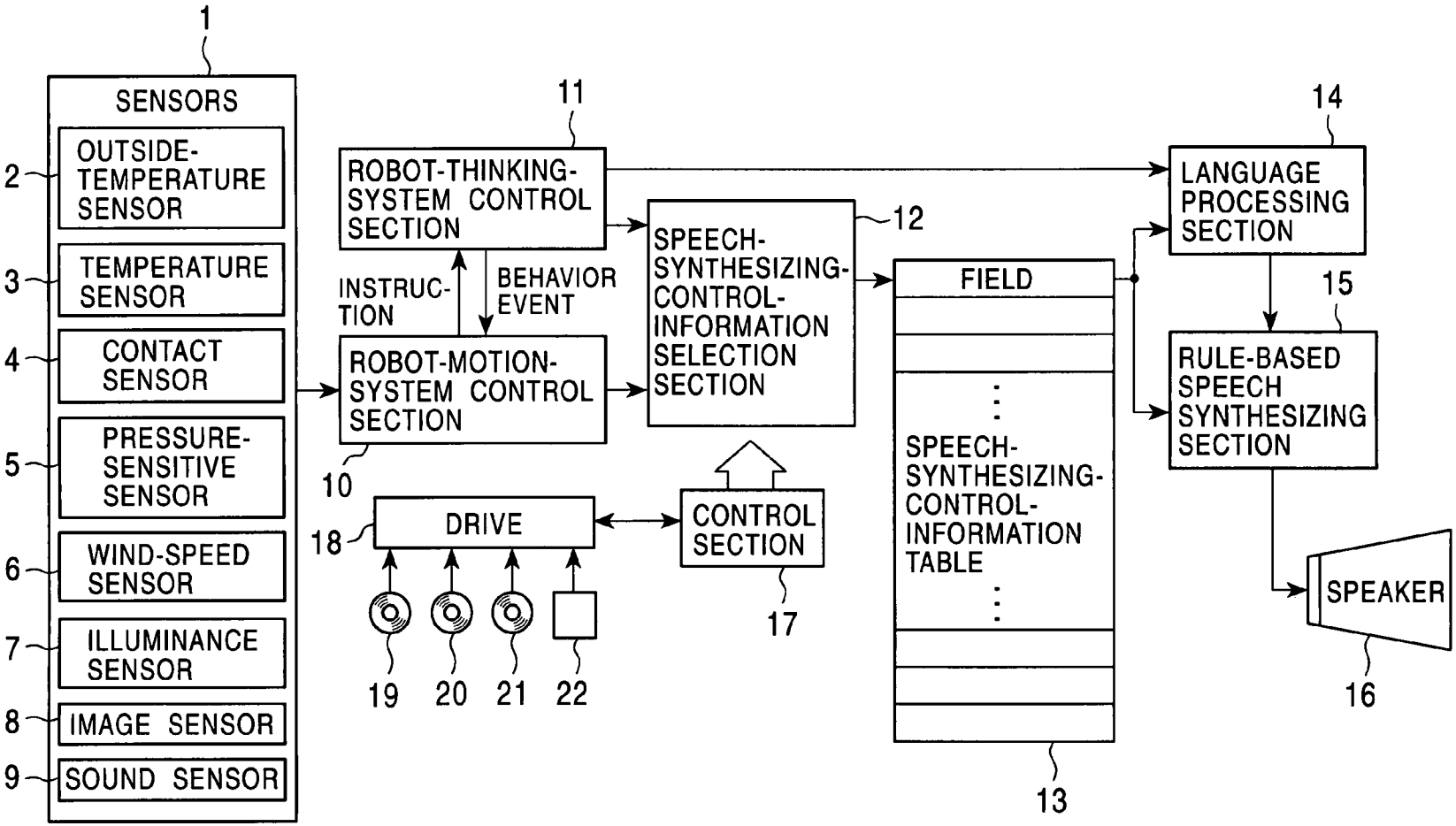
FIG. 1 is a block diagram showing an example structure of a portion related to speech synthesizing of a robot to which the present invention is applied.

FIG. 1 shows an example structure of a portion related to speech synthesizing in a robot to which the present invention is applied. This robot has a word-utterance function, changes the emotion and behavior, and changes the way of speaking according to changes in emotion and behavior.

Various sensors 1 detect conditions outside the robot and an operation applied to the robot, and output the results of detection to a robot-motion-system control section 10. For example, an outside-temperature sensor 2 detects the outside temperature of the robot. A temperature sensor 3 and a contact sensor 4 are provided nearby as a pair. The contact sensor 4 detects the contact of the robot with an object, and the temperature sensor 3 detects the temperature of the contacted object. A pressure-sensitive sensor 5 detects the strength of an external force (such as force applied by hitting or that applied by patting) applied to the robot. A wind-speed sensor 6 detects the speed of wind blowing outside the robot. An illuminance sensor 7 detects illuminance outside the robot. An image sensor 8 is formed, for example, of a CCD, and detects a scene outside the robot as an image signal. A sound sensor 9 is formed, for example, of a microphone and detects sound.

Figure 2:
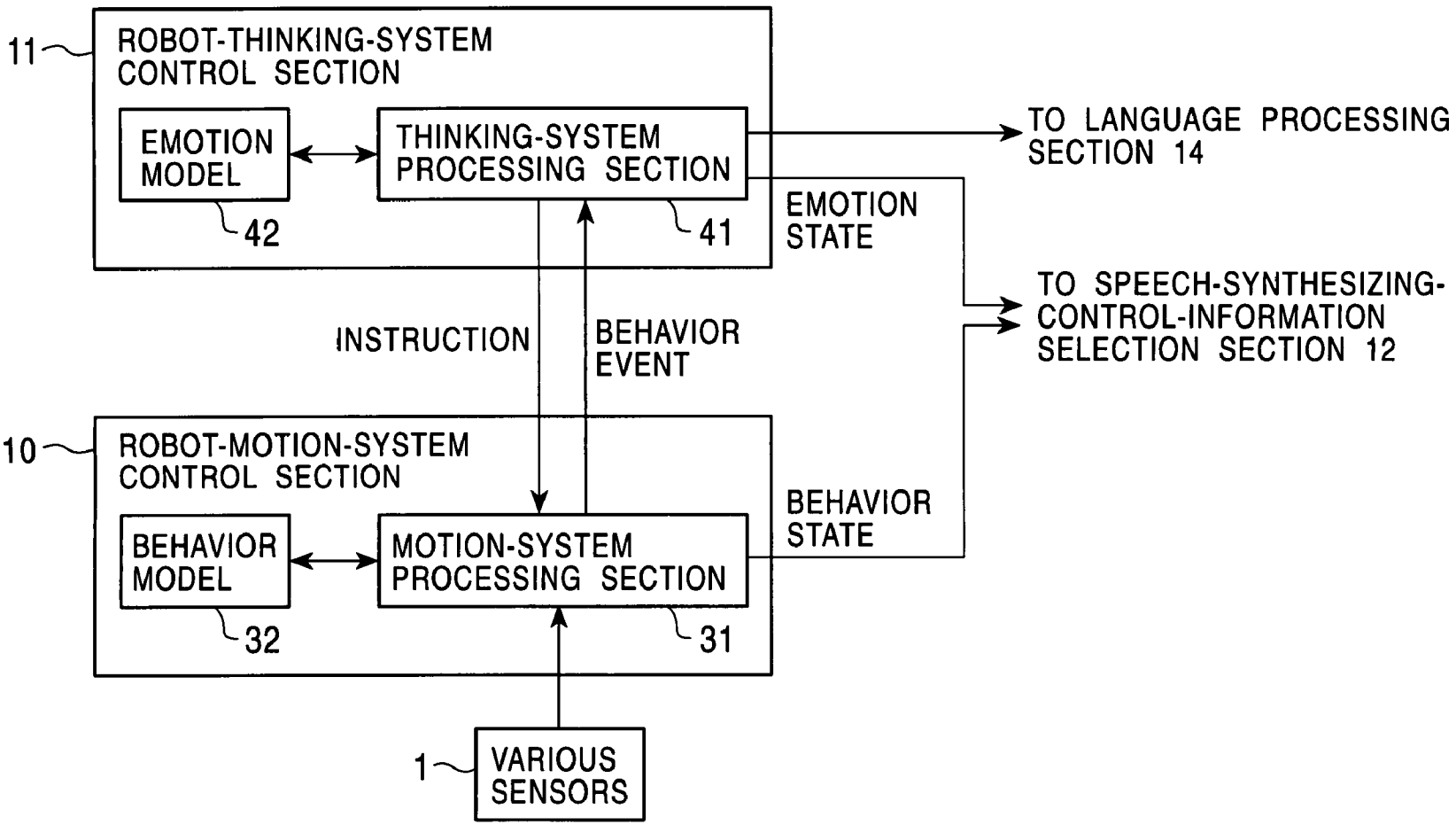
FIG. 2 is a block diagram showing an example structure of a robot-motion-system control section 10 and a robot-thinking-system control section 11 shown in FIG. 1.

The robot-motion-system control section 10 is formed of a motion-system processing section 31 and a behavior model 32, as shown in FIG. 2, and manages the operation of the robot. The motion-system processing section 31 compares the results of detection input from the various sensors 1, an internal event generated in its inside, and an instruction input from a robot-thinking-system control section 11 with the behavior model 32 to change the behavior of the robot, and outputs the current behavior state to an speech-synthesizing-control-information selection section 12 as an behavior state. The motion-system processing section 31 also determines a behavior event according to the results of detection input from the various sensors 1, and outputs to the robot-thinking-system control section 11. When the result of detection achieved by the pressure-sensitive sensor 5 shows a force equal to or more than a predetermined threshold, for example, the motion-system processing section 31 determines that a behavior event is being hit on the head. Furthermore, the motion-system processing section 31 relays the results of detection sent from the various sensors 1, to the robot-thinking-system control section 11. The various sensors 1 may directly input the results of detection to a thinking-system processing section 41.

Figure 3:
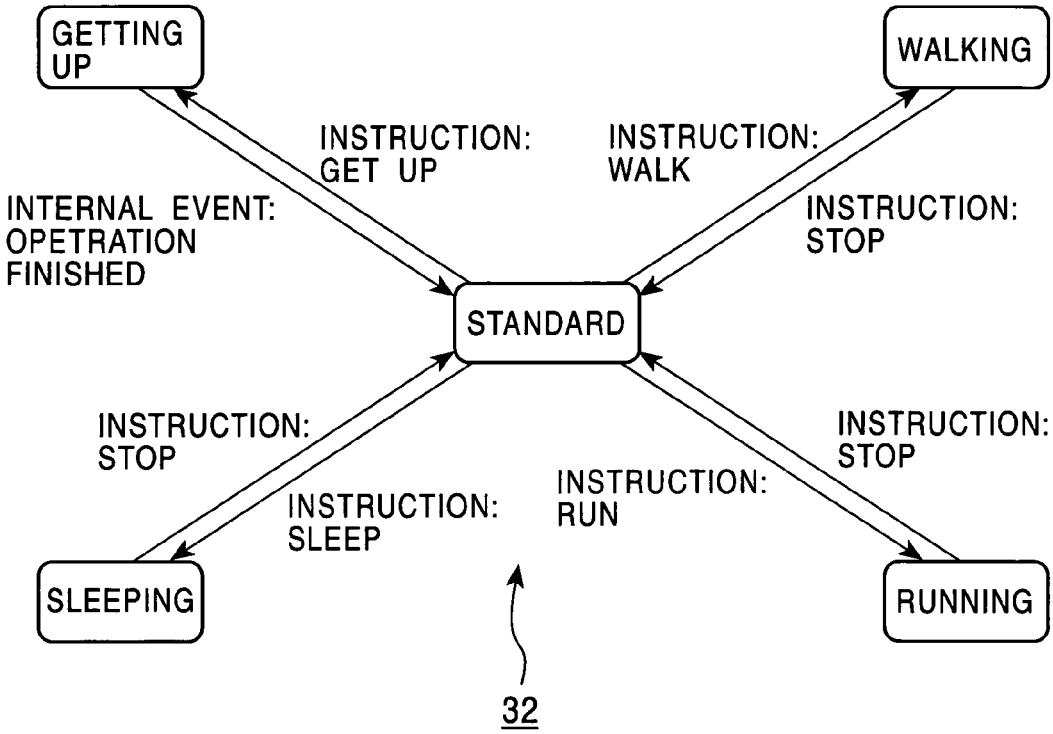
FIG. 3 is a view showing a behavior model 32 shown in FIG. 2.

The behavior model 32 describes a condition used when the robot changes from a standard state to each of various behaviors, as shown in FIG. 3. When the instruction "walk" is issued at the standard state, for example, a transition to the behavior "walking" occurs. When the instruction "get up" is issued, a transition to the behavior "getting up" occurs. When the internal event "operation finished" is generated if the specified behavior is finished, a transition to the standard state occurs.

Back to FIG. 1, the robot-thinking-system control section 11 is formed of the thinking-system processing section 41 and an emotion model 42, as shown in FIG. 2, and manages the emotion of the robot. The thinking-system processing section 41 compares a behavior event input from the motion-system processing section 31, the results of detection achieved by the various sensors 1, and an internal event (such as events periodically generated at an interval of a fixed time period) generated in its inside, with the emotion model 42 to change the emotion of the robot, and outputs the current emotion to the speech-synthesizing-control-information selection section 12 as an emotion state. The thinking-system processing section 41 also outputs an instruction related to a behavior to the motion-system processing section 31 in response to the results of detection achieved by the various sensors 1. Furthermore, the thinking-system processing section 41 generates a text for speech-synthesizing to be uttered by the robot in response to a behavior event and the results of detection achieved by the various sensors 1, and outputs it to a language processing section 14. When the behavior event of "being hit on the head" occurs, for example, the thinking-system processing section 41 generates the text, "ouch," for speech-synthesizing.

Figure 4:
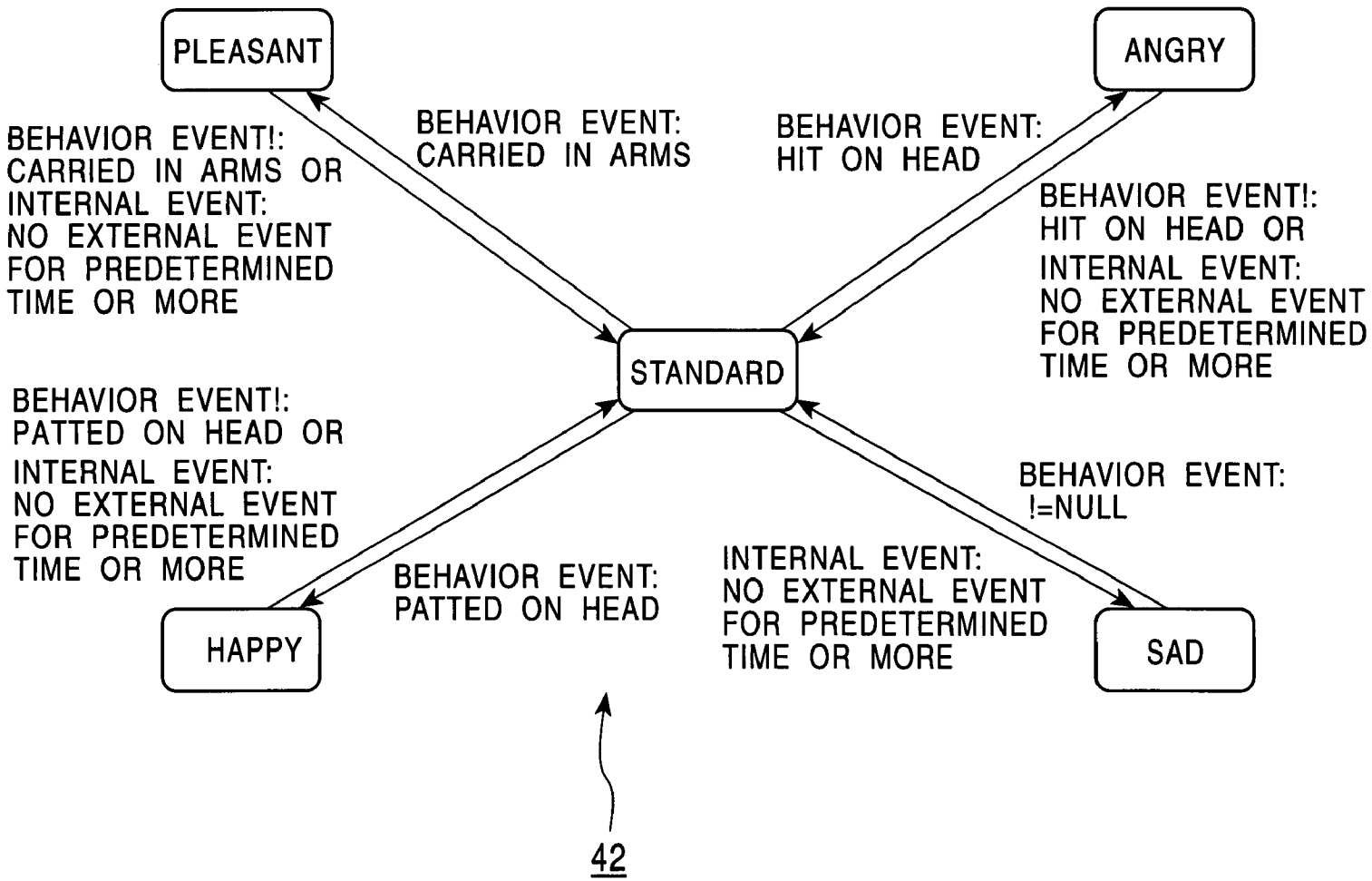
FIG. 4 is a view showing an emotion model 42 shown in FIG. 2.

The emotion model 42 describes a condition used when the robot changes from a standard state to each of various emotions, as shown in FIG. 4. When the behavior event "being hit on the head" occurs at the standard state, for example, a transition to the emotion "angry" occurs. When the behavior event "being patted on the head" occurs, a transition to the emotion "happy" occurs. When an internal event is generated if a behavior event does not occur for a predetermined time period or more, a transition to the standard state occurs.

Back to FIG. 1, the speech-synthesizing-control-information selection section 12 selects a field having the most appropriate speech-synthesizing-control information among many fields prepared in a speech-synthesizing-control-information table 13, according to a behavior state input from the robot-motion-system control section 10 and an emotion state input from the robot-thinking-system control section 11. Upon this selection, a field may be selected according to a parameter added in addition to the operation state and the emotion state (details will be described later by referring to FIG. 8 to FIG. 10).

The speech-synthesizing-control-information table 13 has a number of fields in response to all combinations of behavior states, emotion states, and other parameters (described later). The speech-synthesizing-control-information table 13 outputs the selection information stored in the field selected by the speech-synthesizing-control-information selection section 12 to the language processing section 14, and outputs speech-synthesizing control information to a rule-based speech synthesizing section 15.

Figure 5:
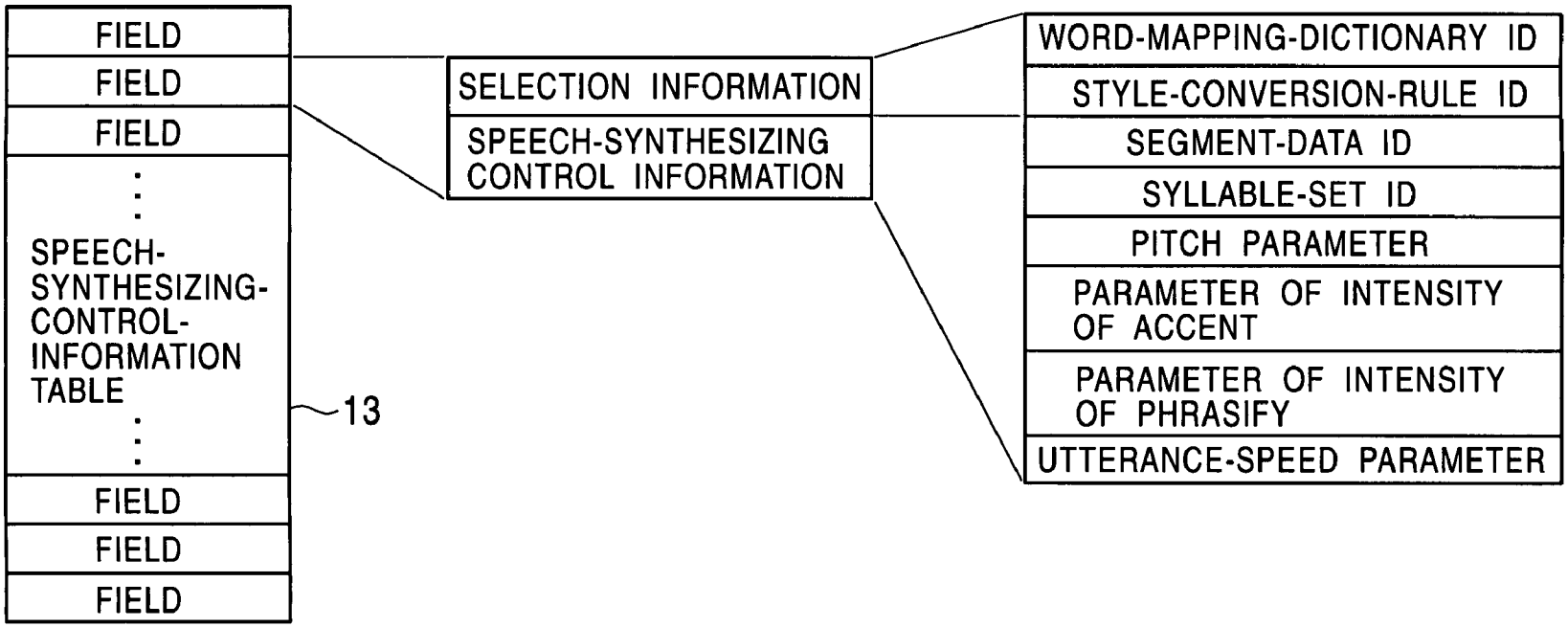
FIG. 5 is a view showing speech-synthesizing control information.

Each field includes selection information and speech-synthesizing control information, as shown in FIG. 5. The selection information is formed of a word-mapping-dictionary ID and a style-conversion-rule ID. The speech-synthesizing control information is formed of a segment-data ID, a syllable-set ID, a pitch parameter, a parameter of the intensity of accent, a parameter of the intensity of phrasify, and an utterance-speed parameter.

Figure 6:
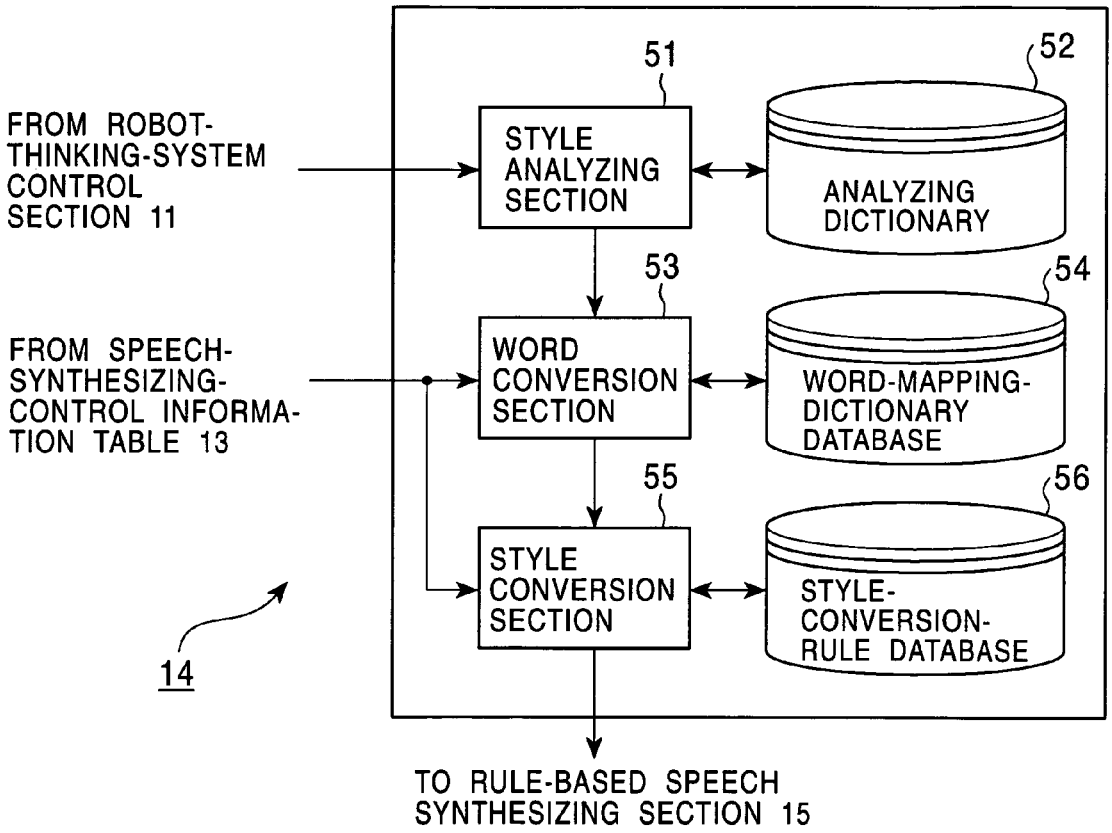
FIG. 6 is a block diagram showing a detailed example structure of a language processing section 14.

Word-mapping-dictionary IDs are prepared in advance in a word-mapping-dictionary database 54 (FIG. 6). Each of them is information to specify a dictionary to be used in a word conversion section 53 (FIG. 6) among a plurality of dictionaries, such as a word mapping dictionary for baby talk, a word mapping dictionary for the Osaka dialect, a word mapping dictionary for words used by girls in senior high schools, and a word mapping dictionary for words used for imitating cats. Word mapping dictionaries are switched according to the personality information, described later, of the robot, and are used for replacing words included in a text for speech-synthesizing expressed in the standard language with other words. For example, the word mapping dictionary for baby talk substitutes the word "buubu" for the word "kuruma" included in a text for speech-synthesizing.

Style-conversion-rule IDs are prepared in advance in a style-conversion-rule database 56 (FIG. 6). Each of them is information to specify a rule to be used in a style conversion section 55 (FIG. 6) among a plurality of rules, such as a rule of conversion to female words, a rule of conversion to male words, a rule of conversion to baby talk, a rule of conversion to the Osaka dialect, a rule of conversion to words used by girls in senior high schools, and a rule of conversion to words used for imitating cats. Style conversion rules are switched according to the personality information, described later, of the robot, and are used for replacing letter strings included in a text for speech-synthesizing with other letter strings. For example, the style rule of conversion to words used for imitating cats substitutes the word "nya" for the word "desu" used at the end of a sentence in a text for speech-synthesizing.

The segment-data ID included in the speech-synthesizing control information is information used for specifying a speech segment to be used in the rule-based speech synthesizing section 15. Speech segments are prepared in advance in the rule-based speech synthesizing section 15 for female voice, male voice, child voice, hoarse voice, mechanical voice, and other voice.

The syllable-set ID is information to specify a syllable set to be used by the rule-based speech synthesizing section 15. For example, 266 basic syllable sets and 180 simplified syllable sets are prepared. The 180 simplified syllable sets have a more restricted number of phonemes which can be uttered than the 266 basic syllable sets. With the 180 simplified syllable sets, for example, "ringo" included in a text for speech synthesizing, input into the language processing section 14, is pronounced as "ningo." When phonemes which can be uttered are restricted in this way, voice utterance of lisping infants can be expressed.

The pitch parameter is information used to specify the pitch frequency of a speech to be synthesized by the rule-based speech synthesizing section 15. The parameter of the intensity of accent is information used to specify the intensity of an accent of a speech to be synthesized by the rule-based speech synthesizing section 15. When this parameter is large, utterance is achieved with strong accents. When the parameter is small, utterance is achieved with weak accents.

The parameter of the intensity of phrasify is information used for specifying the intensity of phrasify of a speech to be synthesized by the rule-based speech synthesizing section 15. When this parameter is large, frequent phrasifies occur. When the parameter is small, a few phrasifies occur. The utterance-speed parameter is information used to specify the utterance speed of a speech to be synthesized by the rule-based speech synthesizing section 15.

Back to FIG. 1, the language processing section 14 analyzes a text for speech synthesizing input from the robot-thinking-system control section 11 in terms of grammar, converts predetermined portions according to the speech-synthesizing control information, and outputs to the rule-based speech synthesizing section 15.

FIG. 6 shows an example structure of the language processing section 14. The text for speech synthesizing sent from the robot-thinking-system control section 11 is input to a style analyzing section 51. The selection information sent from the speech-synthesizing-control-information table 13 is input to the word conversion section 53 and to the style conversion section 55. The style analyzing section 51 uses an analyzing dictionary 52 to apply morphological analysis to the text for speech synthesizing and outputs to the word conversion section 53. The analyzing dictionary 52 describes information required for rule-based speech synthesizing, such as reading of words (morphological elements), accent types, and parts of speech, and a unique word ID of each word.

The word conversion section 53 reads the dictionary corresponding to the word-mapping-dictionary ID included in the selection information, from the word-mapping-dictionary database 54; substitutes words specified in the read word mapping dictionary among the words included in the text for speech synthesizing to which morphological analysis has been applied, sent from the style analyzing section 51; and outputs to the style conversion section 55.

The style conversion section 55 reads the rule corresponding to the style-conversion-rule ID included in the selection information, from the style-conversion-rule database 56; converts the text for speech synthesizing to which the word conversion has been applied, sent from the word conversion section 53, according to the read style conversion rule; and outputs to the rule-based speech synthesizing section 15.

Back to FIG. 1, the rule-based speech synthesizing section 15 synthesizes a speech signal corresponding to the text for speech synthesizing input from the language processing section 14, according to the speech-synthesizing control information input from the speech-synthesizing-control-information table 13. The synthesized speech signal is changed to sound by a speaker 16.

A control section 17 controls a drive 18 to read a control program stored in a magnetic disk 19, an optical disk 20, a magneto-optical disk 21, or a semiconductor memory 22, and controls each section according to the read control program.

Figure 7:
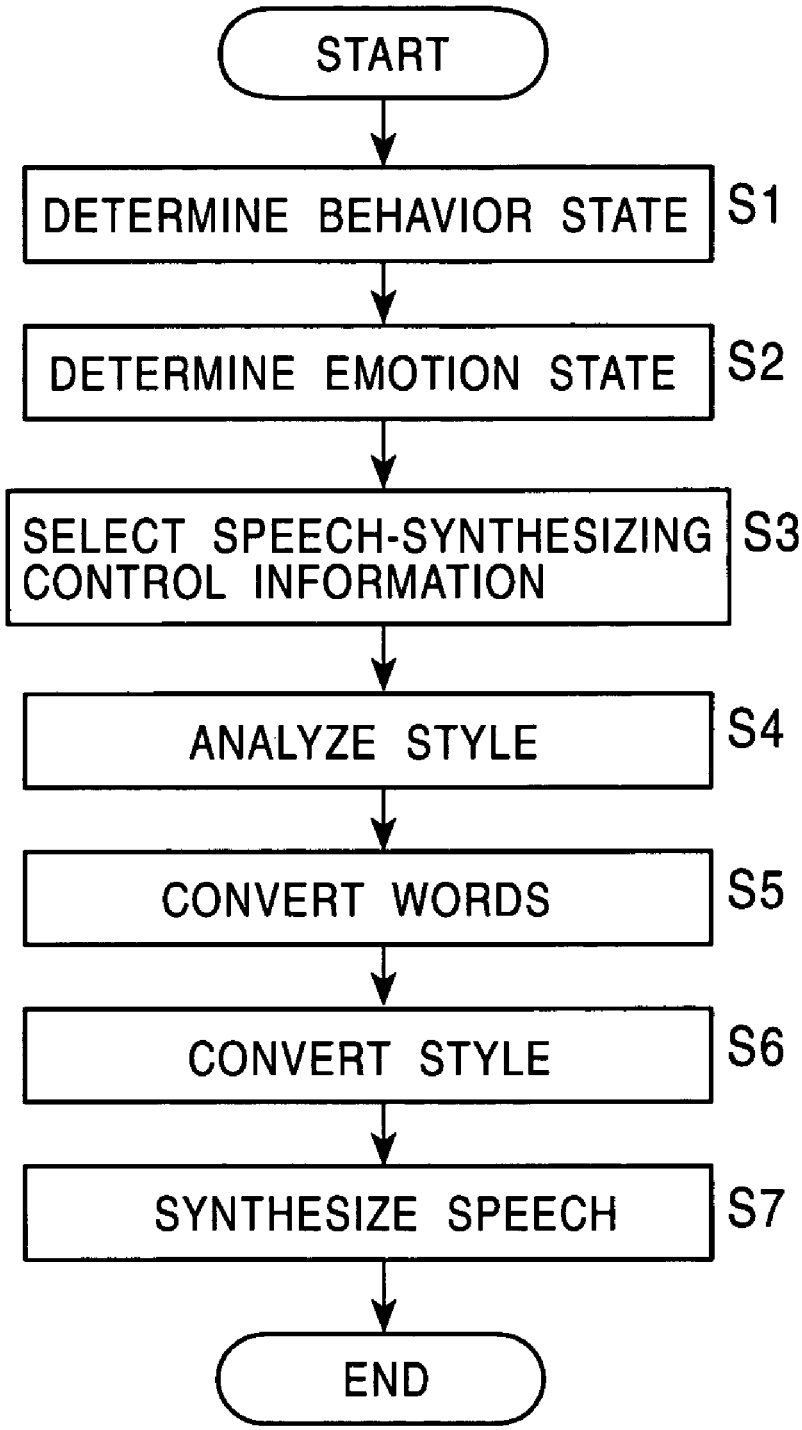
FIG. 7 is a flowchart showing the operation of the robot to which the present invention is applied.

The processing of the robot to which the present invention is applied will be described below by referring to a flowchart shown in FIG. 7. This processing starts, for example, when the pressure-sensitive sensor 5, one of the various sensors 1, detects a condition in which the user hit the head of the robot, and the result of detection is input to the motion-system processing section 31 of the robot-motion-system processing section 10.

In step S1, the motion-system processing section 31 determines that a behavior event "being hit on the head" occurs, when the result of detection achieved by the pressure-sensitive sensor 5 shows that a force equal to or more than a predetermined threshold has been applied, and reports the determination to the thinking-system processing section 41 of the robot-thinking-system control section 11. The motion-system processing section 31 also compares the behavior event, "being hit on the head," with the behavior model 32 to determine a robot behavior "getting up," and outputs it as a behavior state to the speech-synthesizing-control-information selection section 12.

In step S2, the thinking-system processing section 41 of the robot-thinking-system control section 11 compares the behavior event, "being hit on the head," input from the motion-system processing section 31, with the emotion model 42 to change the emotion to "angry," and outputs the current emotion as an emotion state to the speech-synthesizing-control-information selection section 12. The thinking-system processing section 41 also generates the text, "ouch," for speech synthesizing in response to the behavior event, "being hit on the head," and outputs it to the style analyzing section 51 of the language processing section 14.

In step S3, the speech-synthesizing-control-information selection section 12 selects a field having the most appropriate speech-synthesizing control information among a number of fields prepared in the speech-synthesizing-control-information table 13, according to the behavior state input from the motion-system processing section 31 and the emotion state input from the thinking-system processing section 41. The speech-synthesizing-control-information table 13 outputs the selection information stored in the selected field to the speech processing section 14, and outputs the speech synthesizing control information to the rule-based speech synthesizing section 15.

In step S4, the style analyzing section 51 of the language processing section 14 uses the analyzing dictionary 52 to apply morphological analysis to the text for speech synthesizing, and outputs to the word conversion section 53. In step S5, the word conversion section 53 reads the dictionary corresponding to the word-mapping-dictionary ID included in the selection information, from the word-mapping-dictionary database 54; substitutes words specified in the read word mapping dictionary among the words included in the text for speech synthesizing to which morphological analysis has been applied, sent from the style analyzing section 51; and outputs to the style conversion section 55. In step S6, the style conversion section 55 reads the rule corresponding to the style-conversion-rule ID included in the selection information from the style-conversion-rule database 56; converts the text for speech synthesizing to which word conversion has been applied, sent from the word conversion section 53; and outputs to the rule-based speech synthesizing section 15.

In step S7, the rule-based speech synthesizing section 15 synthesizes a speech signal corresponding to the text for speech synthesizing input from the language processing section 14, according to the speech-synthesizing-control information input from the speech-synthesizing-control-information table 13, and changes it to a sound at the speaker 16.

With the above-described processing, the robot behaves as if it had its emotion. The robot changes the way of speaking according to its behavior and the change of its emotion.

A method for adding a parameter other than the behavior state and the emotion state in the selection process of the speech-synthesizing-control-information selection section 12 will be described next by referring to FIG. 8 to FIG. 10.

Figure 8:
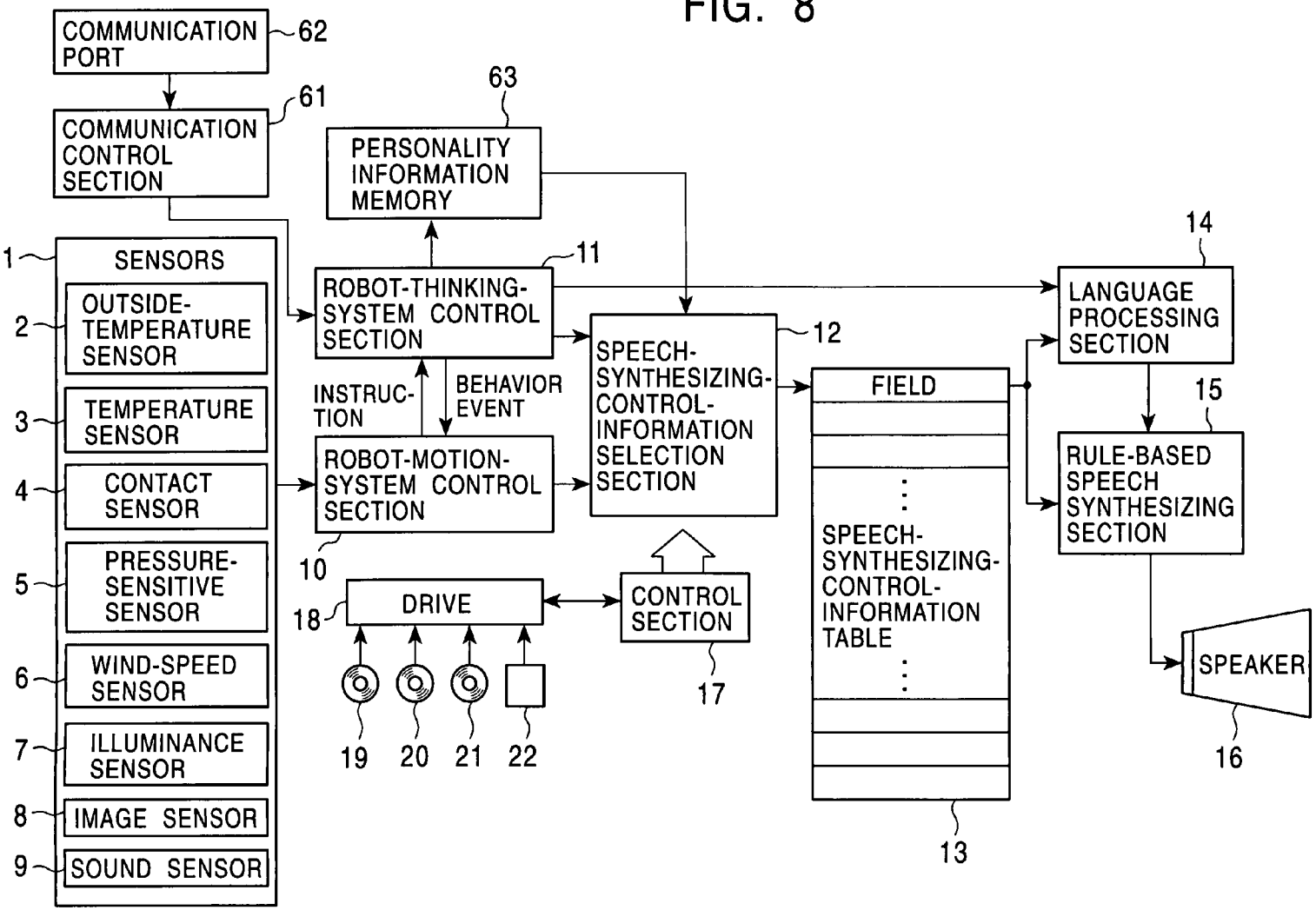
FIG. 8 is a block diagram showing another example structure of the portion related to speech synthesizing of the robot to which the present invention is applied.

FIG. 8 shows an example structure in which a communication port 61, a communication control section 62, and a personality information memory 63 are added to the example structure shown in FIG. 1 to give the robot its personality. The communication port 61 is an interface for transmitting and receiving personality information to and from an external apparatus (such as a personal computer), and can be, for example, one of those conforming to communication standards, such as RS-232C, USB, and IEEE 1394. The communication control section 62 controls information communication with an external unit through the communication port 61 according to a predetermined protocol, and outputs received personality information to the robot-thinking-system control section 11. The personality information memory 63 is a rewritable, non-volatile memory such as a flash memory, and outputs stored personality information to the speech-synthesizing-control-information selection section 12.

The following example items can be considered as personality information sent from the outside.

Type: Dog/cat
Gender: Male/female
Age: Child/adult
Temper: Violent/gentle
Physical condition: Lean/overweight Each of these items is stored in the personality information memory 63 as binary data, 0 or 1. Each item may be specified not by binary data but by multi-valued data.

To prevent personality information from being rewritten very frequently, the number of times it is rewritten may be restricted. A password may be specified for rewriting. A personality information memory 63 formed of a ROM in which personality information has been written in advance may be built in at manufacturing without providing the communication port 61 and the communication control section 62.

With such a structure, a robot which outputs a voice different from that of another robot, according to the specified personality is implemented.

Figure 9:
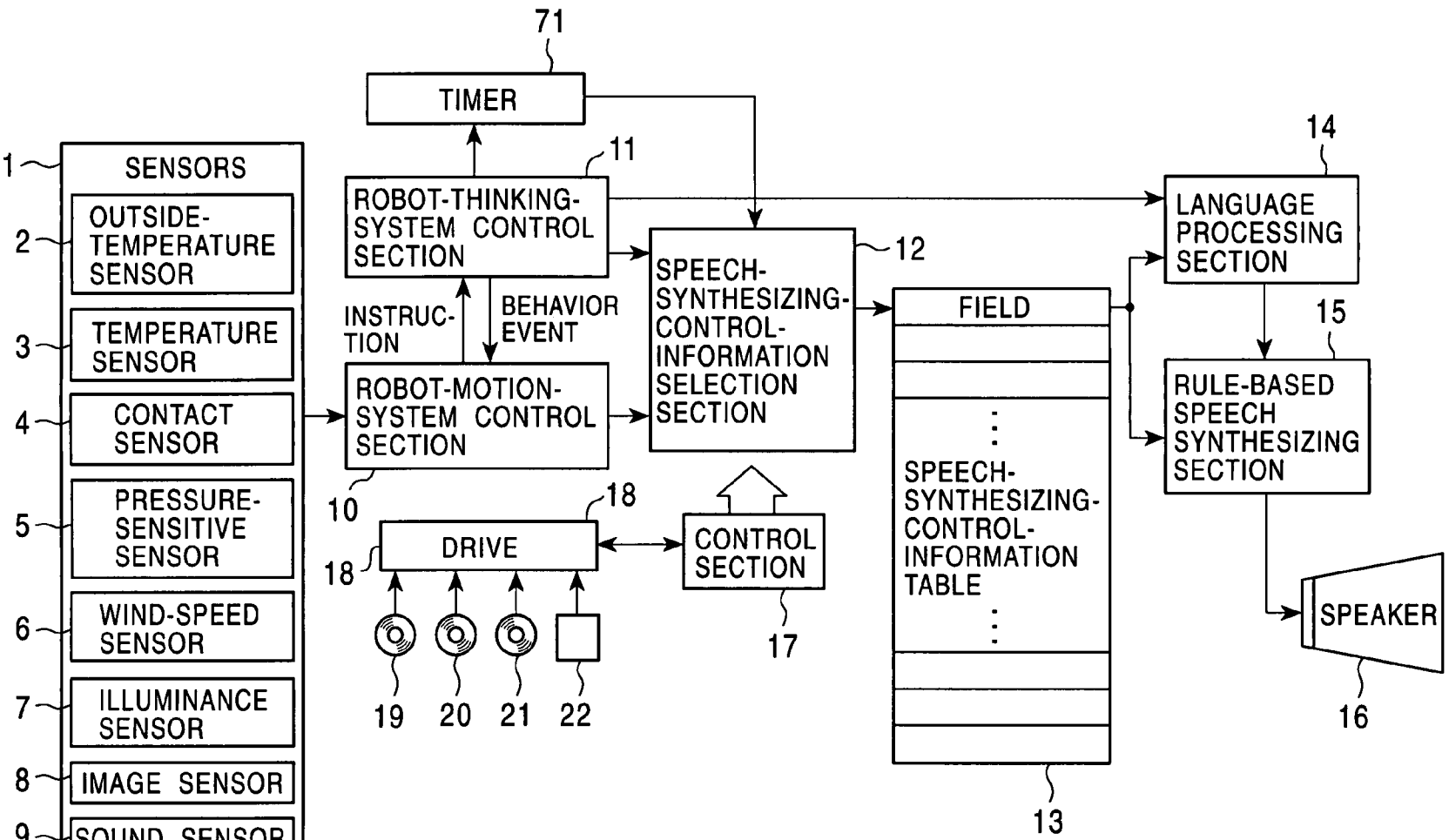
FIG. 9 is a block diagram showing still another example structure of the portion related to speech synthesizing of the robot to which the present invention is applied.

FIG. 9 shows an example structure in which a timer 71 is added to the example structure shown in FIG. 1. The timer 71 counts the elapsed time from when the robot is first activated, and outputs the time to the speech-synthesizing-control-information selection section 12. The timer 71 may count the time in which the robot is being operated, from when the robot is first driven.

With such a structure, a robot which changes an output voice according to the elapsed time is implemented.

Figure 10:
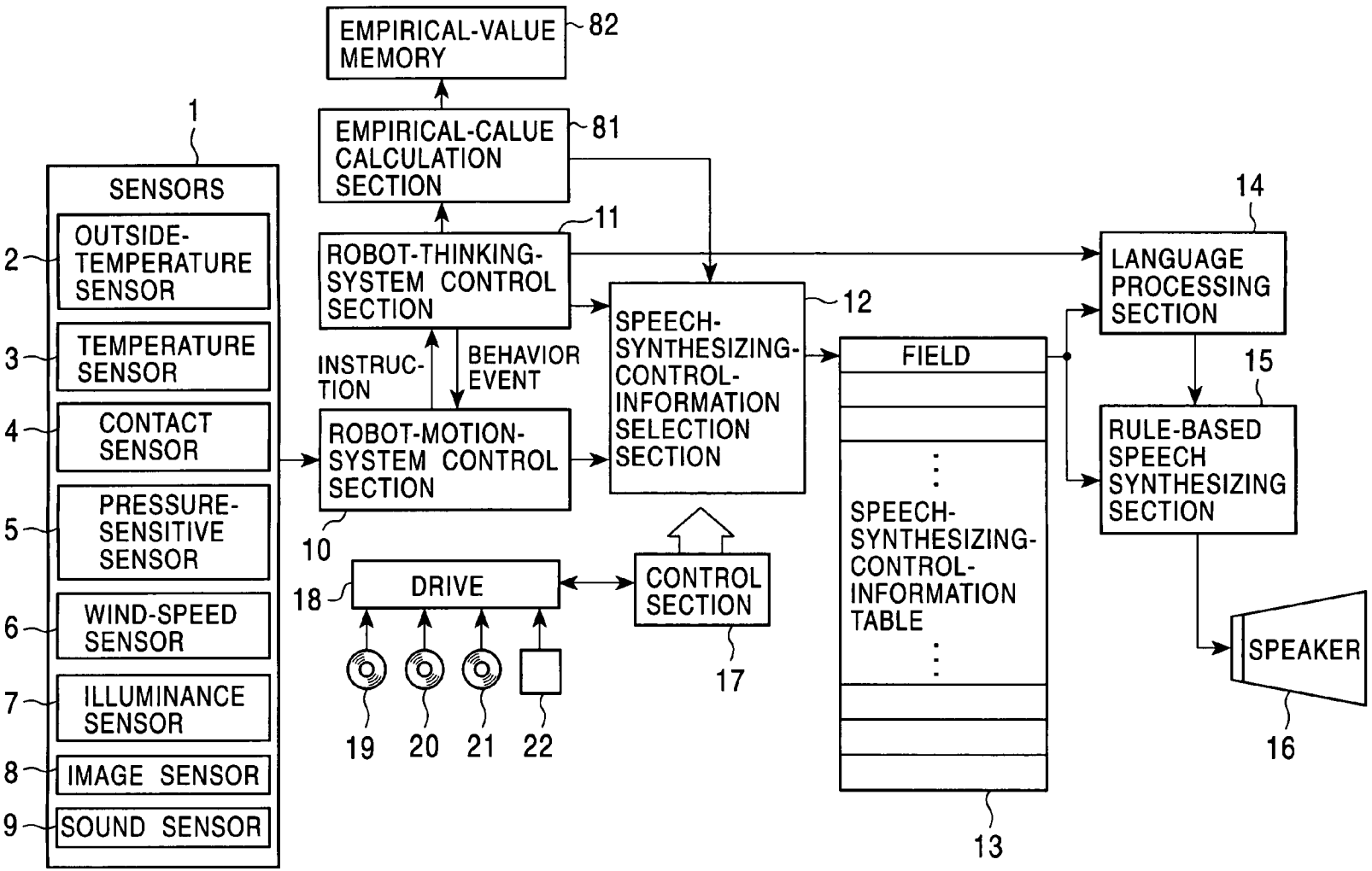
FIG. 10 is a block diagram showing yet another example structure of the portion related to speech synthesizing of the robot to which the present invention is applied.

FIG. 10 shows an example structure in which an empirical-value calculation section 81 and an empirical-value memory 82 are added to the example structure shown in FIG. 1. The empirical-value calculation section 81 counts the number of times emotional transitions occur for each changed emotion state when the thinking-system processing section 41 changes the emotion from the standard state to another state, and stores it in the empirical-value memory 82. When four emotion states are used as in the emotion model 42 shown in FIG. 4, for example, the number of times transitions to each of the four states occur is stored in the empirical-value memory 82. The number of times transitions to each emotion state occur or an emotion state having the largest number of times transitions occur may be reported to the speech-synthesizing-control-information selection section 12.

With such a structure, for example, a robot which is frequently hit and which has a large number of times transitions to the emotion state, "angry," occur can be made to have an easy-to-get-angry way of speaking. A robot which is frequently patted and which has a large number of times transitions to the emotion state, "happy," occur can be made to have a pleasant way of speaking.

The example structures shown in FIG. 8 to FIG. 10 can be combined as required.

The results of detection achieved by the various sensors 1 may be sent to the speech-synthesizing-control-information selection section 12 as parameters to change the way of speaking according to an external condition. When the outside temperature detected by the outside-temperature sensor 2 is equal to or less than a predetermined temperature, for example, a shivering voice may be uttered.

The results of detection achieved by the various sensors 1 may be used as parameters, recorded as histories, and sent to the speech-synthesizing-control-information selection section 12. In this case, for example, a robot having many histories in which the outside temperature is equal to or less than a predetermined temperature may speak a Tohoku dialect.

The above-described series of processing can be executed not only by hardware but also by software. When the series of processing is executed by software, a program constituting the software is installed from a recording medium into a computer having special hardware, or into a general-purpose personal computer which can achieve various functions when various programs are installed.

The recording medium is formed of a package medium which is distributed to the user for providing the program, separately from the computer and in which the program is recorded, such as a magnetic disk 19 (including a floppy disk), an optical disk 20 (including a CD-ROM (compact disc-read only memory) and a DVD (digital versatile disc)), a magneto-optical disk 21 (including an MD (Mini Disc)), or a semiconductor memory 22, as shown in FIG. 1. Alternatively, the recording medium is formed of a ROM or a hard disk which is provided for the user in a condition in which it is built in the computer in advance and the program is recorded in it.

In the present specification, steps describing the program which is recorded in the recording medium include not only processes which are executed in a time-sequential manner according to a described order but also processes which are not necessarily achieved in a time-sequential manner but executed in parallel or independently.

As described above, according to a speech synthesizing apparatus, a speech synthesizing method, and a program stored in a recording medium of the present invention, control information is selected according to one of a behavior state and an emotion state, and a speech signal is synthesized corresponding to a text according to speech synthesizing information included in the selected control information. Therefore, a robot which can change the way of speaking according to the emotion and the behavior to imitate a living thing more real is implemented.

What is claimed is:

1. A speech synthesizing apparatus comprising:

behavior-state changing means, responsive to a behavior event, for changing a behavior state of the apparatus according to a behavior model;

text generating means for generating text in response to said behavior event;

emotion-state changing means for changing an emotion state of the apparatus according to an emotion model;

selecting means for selecting control information according to the behavior state and/or the emotion state;

substituting means, having a number of word substitute dictionaries, for substituting a word or words included in the text with a word or words from the number of word substitute dictionaries in accordance with pre-programmed personality information, wherein said pre-programmed personality information includes a plurality of factors, wherein the plurality of factors included in the pre-programmed personality information used in substituting a word or words included in the text with a word or words from the number of word substitute dictionaries comprise behavioral and emotional state factors, wherein a substitute dictionary is selected from a plurality of substitute dictionaries as a function of the plurality of factors; and synthesizing means for synthesizing a speech signal corresponding to the text according to speech synthesizing information included in the control information selected by the selecting means;

accumulating means for accumulating a number of times the behavior-state changing means changes behavior states of the apparatus and/or the number of times the emotion-state changing means changes emotion states of the apparatus, and wherein the selecting means selects the control information also according to the number of times accumulated by the accumulating means, wherein a voice of said speech synthesizing apparatus is a function of said speech synthesizing information and said pre-programmed personality information.

2. A speech synthesizing apparatus according to claim 1, wherein the speech synthesizing information includes one or more of the following items:

a segment-data ID, a syllable-set ID, a pitch parameter, a parameter of the intensity of accent, a parameter of the intensity of phrasify, or an utterance-speed parameter.

3. A speech synthesizing apparatus according to claim 1, further comprising detecting means for detecting an external condition, wherein the selecting means selects the control information also according to the result of detection achieved by the detecting means.

4. A speech synthesizing apparatus according to claim 1, further comprising:

holding means for holding individual information, and wherein the selecting means selects the control information also according to the individual information held by the holding means.

5. A speech synthesizing apparatus according to claim 1, further compnsing:

counting means for counting the elapsed time from activation, and wherein the selecting means selects the control information also according to the elapsed time counted by the counting means.

6. A speech synthesizing apparatus according to claim 1, wherein the personality information is included in the control information selected by the selecting means.

7. A speech synthesizing apparatus according to claim 1, further comprising:

converting means for converting the style of the text according to a style conversion rule corresponding to selection information included in the control information selected by the selecting means.

8. A speech synthesizing apparatus according to claim 1, wherein the speech synthesizing apparatus is a robot.

9. The speech synthesizing apparatus according to claim 1, wherein the personality information is representative of one or more of the following items: type, gender, age, temperament, or physical condition.

10. A speech synthesizing method for a speech synthesizing apparatus comprising:

a behavior-state changing step, responsive to a behavior event, of changing a behavior state of the apparatus according to a behavior model;

a text generating step of generating text in response to said behavior event;

an emotion-state changing step of changing an emotion state of the apparatus according to an emotion model;

a selecting step of selecting control information according to the behavior state and/or the emotion state;

a substituting step of substituting a word or words included in the text with a word or words from a number of word substitute dictionaries in accordance with pre-programmed personality information, wherein said pre-programmed personality information includes a plurality of factors, wherein the plurality of factors included in the pre-programmed personality information used in substituting a word or words included in the text with a word or words from the number of word substitute dictionaries comprise behavioral and emotional state factors, selecting a substitute dictionary from a plurality of substitute dictionaries as a function of the plurality of factors; and a synthesizing step of synthesizing a speech signal corresponding to the text according to speech synthesizing information included in the control information selected by the process of the selecting step;

an accumulating step for accumulating a number of times the behavior-state changing step changes behavior states of the apparatus and/or the number of times the emotion-state changing step changes emotion states of the apparatus, and wherein the selecting step selects the control information also according to the number of times accumulated by the accumulating step, wherein said speech signal is a function of said speech synthesizing information and said pre-programmed personality information.

11. The method according to claim 10, wherein the personality information is representative of one or more of the following items: type, gender, age, temperament, or physical condition.

12. A computer readable storage medium encoded with a computer program that when executed by a computer causes the computer to:

change a behavior state of an apparatus according to a behavior model, responsive to a behavior event;

generate a text in response to said behavior event;

change an emotion state of the apparatus according to an emotion model;

select control information according to the behavior state and/or the emotion state;

substitute a word or words included in the text with a word or words from a number of word substitute dictionaries in accordance with pre-programmed personality information, wherein said pre-programmed personality information includes a plurality of factors, wherein the plurality of factors included in the pre-programmed personality information used in substituting a word or words included in the text with a word or words from the number of word substitute dictionaries comprise behavioral and emotional state factors, wherein a substitute dictionary is selected from a plurality of substitute dictionaries as a function of the plurality of factors; and synthesize a speech signal corresponding to the text according to speech synthesizing information included in the control information selected by the process of the selecting step;

accumulate a number of times the behavior-state changing step changes behavior states of the apparatus and/or the number of times the emotion-state changing step changes emotion states of the apparatus, and wherein the selecting step selects the control information also according to the number of times accumulated by the accumulating step, wherein said speech signal is a function of said speech synthesizing information and said pre-programmed personality information.

13. The computer readable storage medium encoded with a computer program executed by a computer according to claim 12, wherein the personality information is representative of one or more of the following items: type, gender, age, temperament, or physical condition.

* * * * *